United States Patent [19]

Meyers et al.

[11] 4,037,776

[45] July 26, 1977

[54] CIRCULAR LID

[75] Inventors: George Leroy Meyers, Menasha; Thomas Dominic Pawlowski, Neenah, both of Wis.

[73] Assignee: American Can Company, Greenwich, Conn.

[21] Appl. No.: 680,463

[22] Filed: Apr. 26, 1976

[51] Int. Cl.[2] ..... B65D 5/64; B65D 43/00

[52] U.S. Cl. ..... 229/43; 215/298

[58] Field of Search ..... 229/43, 5.5, 5.6; 206/45.31, 45.34; 215/51, 230, 249, 296, 298

[56] References Cited

U.S. PATENT DOCUMENTS

| | | | |
|---|---|---|---|
| 835,850 | 11/1906 | Cohn | 229/71 |
| 892,086 | 6/1908 | Rese | 215/298 |
| 945,710 | 1/1910 | Doxsee | 229/71 X |
| 1,172,027 | 2/1916 | Lauderman et al. | 215/298 |
| 1,617,783 | 2/1927 | Aicher | 215/298 X |
| 1,744,026 | 1/1930 | Baltzley | 215/298 |
| 2,101,847 | 12/1937 | Gray | 229/71 X |
| 2,310,398 | 2/1943 | Cole | 229/43 |

*Primary Examiner*—Davis T. Moorhead

*Attorney, Agent, or Firm*—Robert P. Auber; Ira S. Dorman; George P. Ziehmer

[57] ABSTRACT

A circular lid is produced from a blank, which consists of a main circular portion from which projects at least one detachable tab. The tab provides a rectilinear trailing edge on the blank, which is adapted for contact by spaced lugs of a conveyor, so that when the blank is pushed through an associated machine by the lugs bearing thereupon, its rotational orientation is maintained. This ensures that registered, sequential operations can be performed on the blank, such as gluing, window film application, printing, and the like.

10 Claims, 5 Drawing Figures

CIRCULAR LID

BACKGROUND OF THE INVENTION

Round containers, having corresponding circular lids or covers, are widely employed in a variety of current packaging applications, such as for commercial baked goods, retail delicatessen foods, and the like. In many instances, such lids are provided with openings, and generally the openings have applied thereover a patch of synthetic film or other translucent material, to provide a window. So long as the opening in the lid is both circular and also concentric, orientation for purposes of applying the window material represents no problem. However, if either the configuration of the opening is non-circular, or the opening (irrespective of its configuration) is asymmetrically disposed in the lid, orientation is a necessary consideration.

More specifically, since a circular member provides no inherent reference point by which its rotational position can be established and maintained, the application of a window film over a non-circular or asymmetrically disposed opening of a circular lid has heretofore necessitated, as a practical matter, the use of a piece of material having an area sufficient to cover the opening in all possible orientations of the lid. This obviously is wasteful of material. Similar difficulties are encountered in the application of glue or printed matter, to a circular lid, in registry with some existing feature thereof.

Accordingly, it is a object of the present invention to provide a novel blank for producing a circular lid or cover, which blank may be employed in a machine without substantial change of angular orientation (rotational position) during passage therethrough.

It is also an object of the invention to provide such a blank, which constitutes a simple and economical modification of conventional blanks used to produce circular lids.

Another object is to provide such a blank, having an opening over which a window film may be applied with a minimum amount of waste of window material.

Still another object is to provide a novel blank of the foregoing type, in which the means for maintaining orientation may be furnished by portions of the lid stock which would normally be discarded as broke.

A further object of the invention is to provide a novel method by which a windowed, circular lid may be produced, economically and with outstanding facility.

SUMMARY OF THE INVENTION

It has now been found that certain of the foregoing and related objects of the present invention are readily attained in a blank, comprising a circular main portion, and tab means projecting from the circumference thereof. The circular portion and the tab means are integrally formed from a piece of lid stock, and are weakly interconnected to enable their facile detachment. The tab means is configured to provide at least two aligned, rectilinear trailing edge portions on the blank, outwardly of the circular portion thereof. The edge portions extend perpendicularly to a medial axis, which is aligned with a diameter of the circular portion of the blank. As a result, engagement members of a machine may engage the trailing edge portions of the tab means, so as to push the blank through the machine with a constant angular orientation.

The tab means of the blank may be provided by a single tab which has symmetrical portions lying to opposite sides of the above-mentioned medial axis, with a continuous outer edge of the tab providing both of the required trailing edge portions. Preferably, the tab means consists of two tabs which are circumferentially spaced from one another on the circular portion of the blank. In such a case, each of the tabs will have a rectilinear outer edge which provides one of the trailing edge portions of the blank. Most desirably, the rectilinear outer edge portions of such a pair of tabs will be aligned on an axis which extends substantially tangent to the circular portion of the blank. The tab means may have lateral edges which extend perpendicularly to the main portion of the blank from the ends of the trailing edge portions thereof, and such lateral edges will advantageously extend along axes which are tangent to the circular portion of the blank.

In the most preferred embodiments, the circular portion of the blank has an opening formed therein, which is of non-circular configuration, asymmetrically disposed, or both non-circular and also asymmetrically disposed therein. Generally, such a blank will additionally include a patch of window material secured to one surface thereof, over the opening, to provide a window in the blank; the area of such a patch will advantageously be only slightly greater than that of the opening. In most instances, the lid stock employed will comprise a paperboard material.

Other objects of the invention are readily attained in a method for applying a patch of window material to a piece of lid stock having an opening therein. In accordance therewith, a blank having an opening therein, as hereinabove described, is disposed in a machine adapted to apply a patch of window material to a piece of lid stock, with the trailing edge portions of the blank rearwardly directed. Each of the trailing edge portions of the tab means is contacted with an engagement member which is movable along a travel path through the machine, the engagement members being aligned on a transverse axis which is perpendicular to the axis of the travel path; the blank is pushed along the travel path by movement of the engagement members in such contact with the trailing edge portions thereof. At a first location along the travel path, an adhesive is deposited upon the blank substantially about the opening in the circular portion thereof, after which a patch of window material, having an area only slightly greater than that of the opening, is applied thereover at a second location along the travel path, so as to effect a bond with the adhesive. Finally, the tab means is detached from the circular portion of the blank, to provide a circular lid having a window therein.

BRIEF DESCRIPTION OF THE INVENTION

DETAILED DESCRIPTION OF THE ILLUSTRATED EMBODIMENTS

Figure 1:
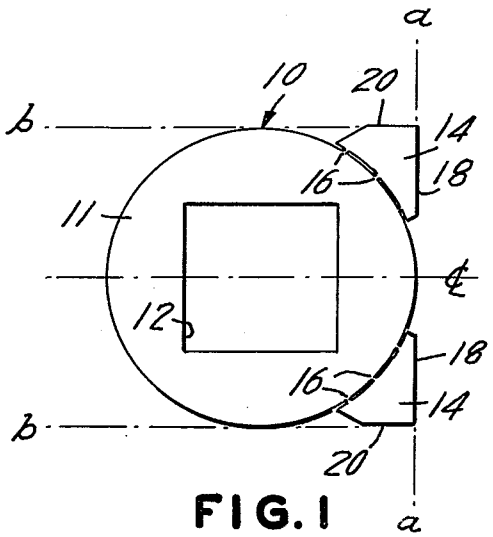
FIG. 1 is a plan view of a blank embodying the present invention.

Turning now in detail to FIG. 1 of the appended drawing, therein illustrated is a blank for producing a circular lid, embodying the present invention and being generally designated by the numeral 10. It consists of a circular main portion 11 having a square opening 12 formed therein, and a pair of generally triangular tabs 14 attached thereto. The tabs 14 and the portion 10 are die-cut from a single piece of paperboard lid stock, and are interconnected solely by narrow uncut bridge elements or nips 16, producing a very weak joint and facilitating ready removal of the tabs 14, at the appropriate time. As can be seen, a diameter of the circular portion 10 constitutes a medial axis between the tabs 14, and represents the centerline of the overall blank 10. Each of the tabs 14 has a rectilinear outer edge 18, which edges 18 are aligned on an axis "*a*", extending perpendicularly to the centerline of the blank 10 and tangent to the circular portion 11 thereof. In addition, each tab 14 has a rectilinear lateral edge 20, which is aligned on an axis *b* extending perpendicularly to the axis *a* and also tangent to the portion 11. Since, in cutting a circular lie from a web of stock material, a square of material equal in length and width to the diameter of the circle is normally consumed, it will be appreciated that the tabs 14 are provided by areas of broke, which would normally be discarded. Accordingly, the tabs 14 are furnished without waste of any material, other than that which would be used in any event. As will be more fully explained hereinbelow, the outer edges 18 are employed to enable oriented conveyance of the blank through a machine; the lateral edges 20 may also be employed to control the position of the blank, but in a lateral sense, if the associated equipment is provided with appropriate side rails or walls on which the edges 20 may ride.

Figure 2:
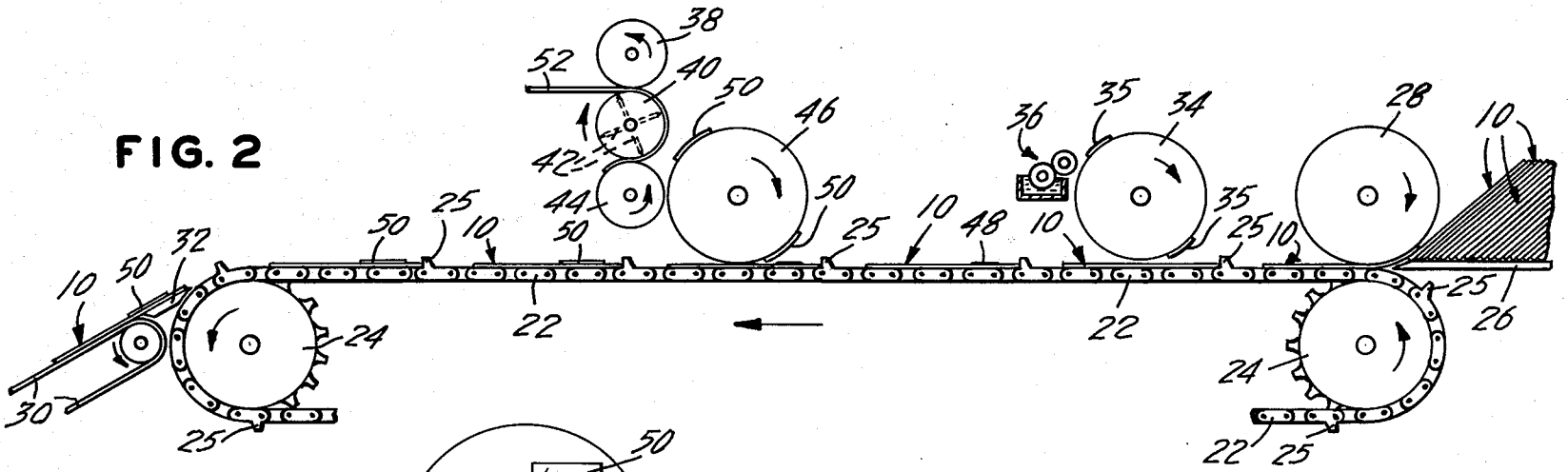
FIG. 2 is a fragmentary, diagramatical, elevational view of a system in which the lid-producing method of the invention may be practiced.

Turning now to FIG. 2 of the drawing, a system for applying window film to blanks of the sort shown in FIG. 1 is illustrated. The system includes a pair of parallel, endless chain conveyors 22 (only one of which is visable), which are disposed about appropriately driven sprockets 24 and have a series of lugs 25 protruding outwardly therefrom at equidistantly spaced locations along its length, the lugs 25 on the two conveyors 22 being aligned in pairs on transverse axes perpendicular to the travel path thereof. A blank feeding mechanism, consisting of a support member 26 for the blanks 10 and a rotating feed wheel 28, is disposed adjacent one end of the system, and an outfeed mechanism, consisting of a pulley-driven belt 30 and an interposed platform 32, is positioned at the opposite end thereof. At a first location along the travel path, a glue station, consisting of an applicator drum 34 and an associated fountain assembly generally designated 36, is provided and, at a second location spaced downstream from the first, a film applying station is furnished. The latter consists of an upper feed roll 38, a lower feed roll 40 having cam-actuated cut-off knives 42 mounted therein, a vacuum take-off roll 44, and a vacuum applying drum 46.

In operation, as the chain conveyors 22 rotate over the sprockets 24, individual blanks 10 are fed seriatim by the wheel 28 onto the upper flight thereof. Pairs of lugs 25 (as will be more fully described hereinafter) engage the deposited blanks 10 and push them along the travel path of the system. During passage of the blanks 10 under the glue station, the rotating drum 34 transfers a quantity of glue 48 from the fountain assembly 36 to the surface of the blank, the drum surface bearing embossments 35 which are suitably configured to produce the desired glue pattern. When each of the blanks reaches the window-applying station, a patch 50 of film is deposited on the blank 10 from the vacuum drum 46. As will be appreciated, the patch of film 50 is severed from the fragmentarily illustrated web 52 thereof which, in turn, is delivered and cut by the assembly comprised of rolls 38, 40 and 44. Finally, the windowed blanks 10 are carried by the conveyors 22 to the outfeed mechanism, where they are deposited upon the platform 32 and thereafter discharged on the belt 30.

Figure 5:
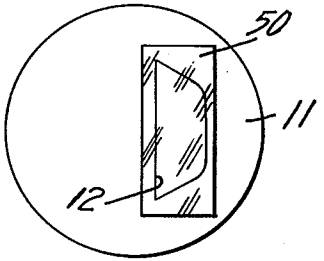
FIG. 5 is a plan view of the lid produced from the windowed blank of FIG. 3, drawn to a scale reduced therefrom.
Figure 4:
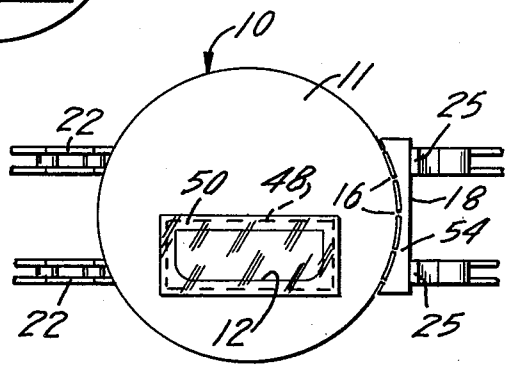
FIG. 4 is a view similar to FIG. 3, utilizing yet another form of blanks embodying the invention.
Figure 3:
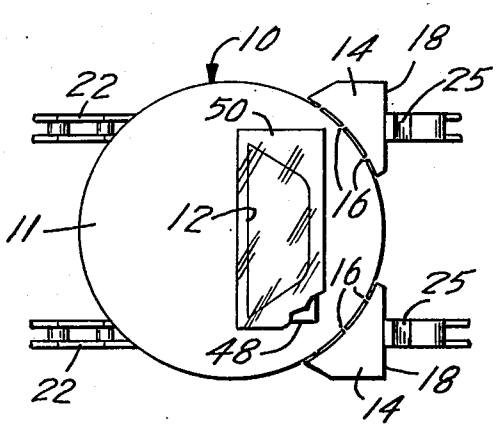
FIG. 3 is a plan view of a lid slightly modified from that of FIG. 1, having a window film applied thereto and being supported upon a section of the conveyors of the system of FIG. 2, drawn to a scale enlarged therefrom.

FIGS. 3 and 4 better illustrate the detailed construction of blanks, as augmented with window film, and also more clearly show the manner in which the lugs of the conveyor engage the same; the blanks may be regarded in these figures to be in positions downstream of the film application station. More particularly, FIG. 3 shows a blank 10 which, except for the configuration of the opening 12 therein, is substantially the same as that depicted in FIG. 1. As can be seen, a lug 25 of each of the pair of spaced, parallel chain conveyors 22 engages the rectilinear outer edge 18 of one of the tabs 14. The blank 10 has applied to its surface a quantity of glue 48, in a pattern corresponding substantially to the configuration of the opening 12, which bonds thereto a patch 50 of film the area of which patch is only slightly greater than the area of the opening 12. Due to the presence of the rectilinear outer edges 18, and the secure engagement (at two spaced points) of the lugs 25 on the resultant trailing edge, the blank 10 can be pushed through a system of the sort shown in FIG. 2 with no change in its angular orientation. The glue 48 can therefore be accurately registered with the opening 12, and the patch 50 can, in turn, be accurately registered thereover. Consequently, materials are conserved and operation is-facilitated thus enabling maximization of production rates. As will be appreciated, the tabs 14 will be removed in a subsequent operation, to ultimately produce a windowed lid having a circular external configuration (comprised of the portion 11), as shown in FIG. 5.

Turning finally to FIG. 4, a blank 10 similar to those previously described, but having a slightly different opening and tab configuration, is illustrated. More particularly, rather than being provided with a pair of spaced tabs (such as 14), the blank 10 of this figure has a single, elongated tab 54, which provides a continuous trailing edge 18 extending to opposite sides of the centerline thereof. While the tab 54 provides the same advantages as did the tabs 14, in terms of conveyance by lugs 25 with constant orientation, this construction requires more lid stock, and is therefore less desirable from that standpoint. Thus, insofar as the tab 54 extends along the blank centerline beyond the periphery of the circular portion 11, additional material must be provided. The blank 10 of FIG. 4 also illustrates a configuration and disposition of the window 12 in the portion 11 which is different from those of the embodiments hereinbefore described.

It should be appreciated that, while the opening 12 of the blank 10, of FIG. 1 is symmetrically disposed thereon, those of the blanks of FIGS. 3 and 4 are not. Although all of the openings shown are of non-circular configuration, the benefits of the instant invention are equally realized in a blank having a circular opening which is non-concentrically disposed in the circular portion thereof, such eccentric disposition being regarded herein as "asymmetrical".

It should be also noted that, while the advantages of the invention are most significant in the production of lids having openings over which a window material is to be applied, the concepts hereof should not be regarded to be so limited in scope. For example, in printing operations necessitating maintenance of the rotational attitude of a round lid during its movement from station-to-station, the blank construction herein described has significant value. Similarly, the configurations of the tabs specifically illustrated are provided primarily for exemplary purposes, and should not be construed to limit the scope of the invention. It is essential only that the tab member be detachable from the circular main portion with reasonable facility, and that it provide on the blank at least two aligned rectilinear trailing edge portions, disposed outwardly of the circular portion and extending perpendicularly to the medial, diametrically aligned axis.

The selection of materials of construction for the blank will be evident to those skilled in the art. Generally, the lid itself will be made of paperboard; however, other materials such as plastic, metal foil, and laminated combinations thereof may also be employed. Typical materials utilized to produce the window include polystyrene, polyethylene, polypropylene, cellulose esters, regenerated cellulose films (with or without coatings such as vinyl chloride/ vinylidene chloride copolymer), polyethylene terethalate, and the like. The particular adhesive employed will, of course, depend upon the materials to be bonded and the conditions of operation, and the choice thereof will be similarly apparent to the skilled practitioner. Finally, it should be understood that the mechanical system shown in the drawing is provided only to illustrate the method of the invention, and that in a practical situation the system may be much more complex, and of an entirely different basic design. Nevertheless, it might be mentioned that, while not illustrated, support bars or similar structure will normally be provided to extend along conveyor chains of the type described, to furnish a surface on which the blanks may slide while being propelled through the system.

Thus, it can be seen that the present invention provides a novel blank for producing a circular lid or cover, which blank may be employed in a machine without substantial change of its angular orientation (rotational position) during passage therethrough. The blank may constitute a simple and economical modification of conventional blanks used to produce circular lids, and the means for maintaining orientation may be furnished by normally discarded broke. The invention provides a preferred construction wherein the blank has an opening over which a window material may be applied with a minimum amount of waste thereof. Finally, a novel method is provided whereby a windowed, circular lid may be produced economically and with outstanding facility.

Having thus described the invention, what is claimed is:

1. A unit blank for producing a single circular lid, comprising a circular main portion, and tab means projecting from the circumference thereof, said circular portion and said tab means being integrally formed from a piece of lid stock and having weak interconnecting means therebetween for facile detachment of said tab means, said tab means being configured to provide at least two rectilinear trailing edge portions on said blank outwardly of said circular portion, said edge portions being aligned on a common axis extending perpendicularly to a medial axis, which medial axis is aligned with a diameter of said circular portion of said blank, whereby engagement members of a machine may contact said blank on said trailing edge portions of said tab means, to push said blank through the machine with a constant angular orientation.

2. The blank of claim 1 wherein said tab means is a single tab having symmetrical portions lying to opposite sides of said medial axis, said trailing edge portions being provided by a continuous outer edge of said tab.

3. The blank of claim 1 wherein said tab means consists of two tabs circumferentially spaced from one another on said circular portion of said blank, each of said tabs having a rectilinear outer edge which provides one of said trailing edge portions on said blank.

4. The blank of claim 3 wherein said rectilinear outer edge portions are aligned on an axis which extends substantially tangent to said circular portion of said blank.

5. The blank of claim 1 wherein said tab means has lateral edges which extend perpendicularly to said circular portion of said blank from the ends of said trailing edge portions thereof.

6. The blank of claim 5 wherein said lateral edges extend along axes which are tangent to said circular portion thereof.

7. The blank of claim 1 wherein said circular portion has formed therein an opening which is of non-circular configuration, asymmetrically disposed, or both non-circular and also asymmetrically disposed therein.

8. The blank of claim 7, additionally including a patch of window material secured to one surface thereof over said opening, to provide a window in said blank.

9. The blank of claim 8 wherein the area of said patch is only slightly greater than the area of said opening.

10. The blank of claim 1 wherein said lid stock comprises a paperboard material.

* * * * *